United States Patent [19]

Platt et al.

[11] 4,127,015

[45] Nov. 28, 1978

[54] AGITATOR ASSEMBLY WITH CLOTHES CAMMING RAMP FOR AUTOMATIC WASHER

[75] Inventors: Clark I. Platt; Jack F. Clearman, both of St. Joseph, Mich.

[73] Assignee: Whirlpool Corporation, Benton Harbor, Mich.

[21] Appl. No.: 840,025

[22] Filed: Oct. 6, 1977

[51] Int. Cl.[2] ..... D06F 17/10

[52] U.S. Cl. ..... 68/133; 68/134

[58] Field of Search ..... 68/131–134, 68/53, 54

[56] References Cited

U.S. PATENT DOCUMENTS

| | | | |
|---|---|---|---|
| 2,630,696 | 3/1953 | Castner | 68/131 |
| 3,987,651 | 10/1976 | Platt | 68/133 |

FOREIGN PATENT DOCUMENTS

| | | | |
|---|---|---|---|
| 1,219,088 | 12/1959 | France | 68/134 |
| 728,096 | 4/1955 | United Kingdom | 68/133 |

*Primary Examiner*—Philip R. Coe

*Attorney, Agent, or Firm*—Hill, Gross, Simpson, Van Santen, Steadman, Chiara & Simpson

[57] ABSTRACT

An automatic washing machine of the vertical axis, oscillating agitator type promotes an improved rollover washing action. A separate lower camming element beneath the skirt portion of the upper, oscillating agitator is moved in a stepwise, unidirectional rotation about the axis and carries on an outer periphery thereof at least one ramp surface inclined upwardly opposite its direction of rotation. A clutch arrangement between the agitator skirt and the camming element effects positive rotation of the element during a portion of each one-half cycle of agitator oscillation, leaving the element at rest during the other part of the oscillation cycle. In one embodiment a ratchet-type clutch is employed having inclined teeth on the agitator skirt and spaced-apart, oppositely-inclined lugs or notches on a cooperating portion of the camming element.

15 Claims, 12 Drawing Figures

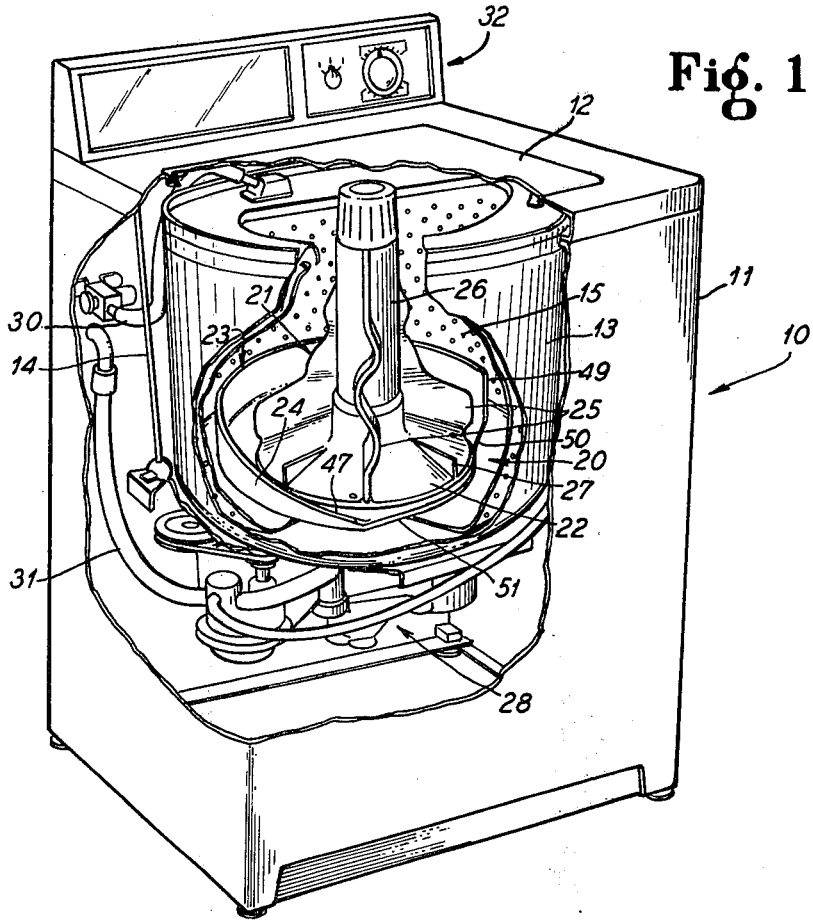
Fig. 1
Fig. 2
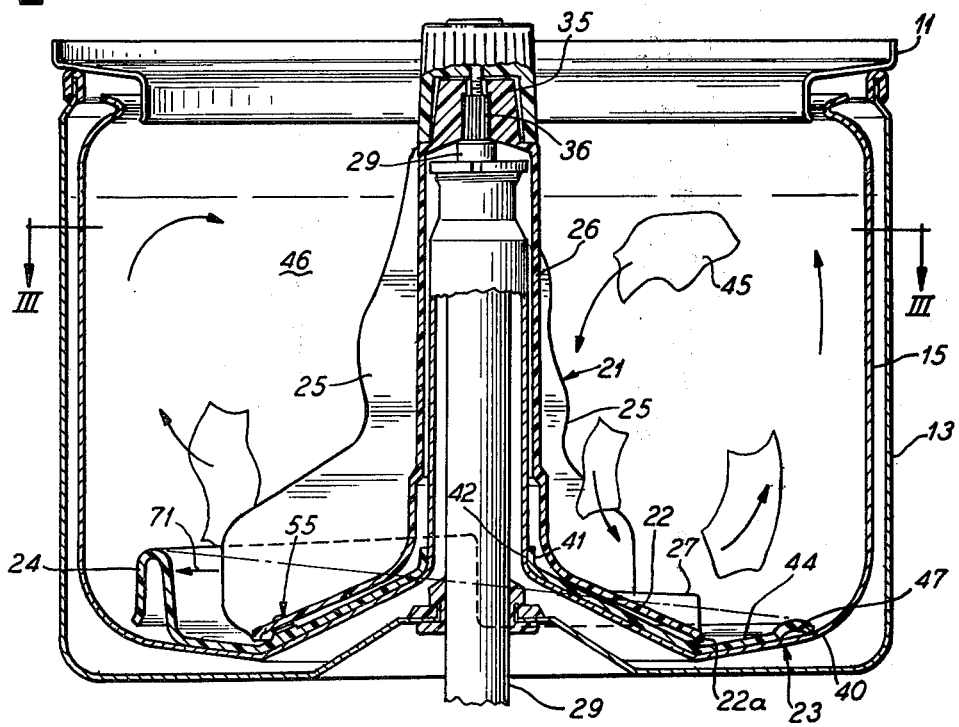

AGITATOR ASSEMBLY WITH CLOTHES CAMMING RAMP FOR AUTOMATIC WASHER

RELATED APPLICATIONS

This is one of four simultaneously-filed applications all assigned to the assignee of the present application and relating to improved agitator structures identified as follows:

| USSN | Title |
|---|---|
| 823,715 filed August 11, 1977 | Double Action Agitator with Curved Rigid Vanes on Skirt |
| 839,998 filed October 6,1977 | Double Action Agitator with Clothes Lifting Cams on Skirt |
| 839,997 filed October 6, 1977 | One-Piece Agitator with Clothes Lifting Cams |

BACKGROUND OF THE INVENTION

1. Field of the Invention

The present invention is in the field of automatic washing machines employing vertical axis agitators which oscillate to provide a generally toroidal rollover motion to clothes and wash fluid within the machine, and is particularly pertinent to those agitator constructions useful with large or heavy clothes loads for improving the rollover movement of clothes within the machine to promote uniform soil removal from all portions of the clothes and fabrics undergoing washing.

Maximum clothes rollover is desired to expose all portions of the wash load to adequate scrubbing action. With relatively small to medium wash loads a conventional agitator will cause sufficient clothes movement during washing to achieve satisfactory relatively uniform washing of the clothes.

However, with relatively large wash loads the clothes and fabrics tend to bunch up in the washer basket and adequate circulation of the clothes is prevented. Thus only parts of the load are exposed to effective scrubbing action. This results in a non-uniform washing result with parts of the clothing becoming clean while other parts not exposed to scrubbing action of the agitator remain soiled.

2. The Prior Art

This application is related to co-pending application Ser. No. 696,746, filed June 16, 1976, now U.S. Pat. No. 4,068,053 issued Jan. 17, 1978 which was a continuation-in-part of application Ser. No. 595,792, filed July 14, 1975, now U.S. Pat. No. 3,987,651, which was in turn a continuation of application Ser. No. 418,378, filed Nov. 23, 1973 and now abandoned.

It has been discovered that for effective, uniform soil removal a very efficient movement pattern for clothes and/or fabrics undergoing washing within an automatic, vertical washing machine is one of toroidal rollover. For example, such rollover action may be effected by moving the clothes down adjacent the agitator barrel, radially outwardly from the oscillating agitator vanes in the bottom of the wash basket, upwardly along the wall of the basket, and inwardly to the barrel at the surface of the wash fluid, forming a toroidal pattern in the wash basket.

U.S. Pat. Nos. 3,987,508 and 3,987,651 have recently been issued to one of the present inventors and the assignee of the present application for an apparatus and a method for washing clothes, respectively. Both patents disclose structures employing two-part agitators including an upper auger portion which rotates unidirectionally and an oscillating lower portion having vertically-oriented scrubbing vanes. U.S. Pat. No. 3,987,652 issued to the assignee of the present application, also discloses a two-part agitator system for achieving improved roll-over of large loads of clothing in an automatic washer. When the washing basket is heavily loaded with clothes, the load tends to crowd the agitator and basket and may interfere with efficient rollover action. In machines using conventional agitators which do not include the rollover features of the above mentioned patents, the agitator tends to scrub only the bottom portion of the tightly packed load, that is the portion contacted by the scrubbing vanes on the skirt, resulting in a very poor and uneven washing action.

U.S. Pat. No. 1,806,982 discloses an automatic washer having an oscillating agitator and a horizontal disk which is unidirectionally rotated in the bottom of the clothes washing basket. Rotation of the disk creates upward jets of water from scoops on the disk, aiding in clothes rollover. U.S. Pat. No. 1,635,402 similarly employs upwardly directed water jets at the lower periphery of the clothes basket to aid in clothes rollover.

U.S. Pat. Nos. 2,192,758 and 3,029,623 disclose automatic washing machines having inwardly extending flow-directing baffles mounted on the side walls of the clothes container. U.S. Pat. Nos. 1,665,959, 1,810,047 and 2,230,477 disclose various forms of oscillating agitators having asymmetric vane surfaces.

SUMMARY OF THE INVENTION

An improved agitator assembly for use with an automatic washer has a clothes washing receptacle and drive means for driving a vaned agitator in oscillatory fashion. A separate camming element is disposed in the receptacle below the skirt of the agitator, the camming element having a camming or contacting surface extending upwardly from a periphery thereof in the form of a spiral ramp. A clutch or coupling device interconnects the agitator skirt with the camming element to effect substantially unidirectional rotation of the camming element concurrently with oscillation of the agitator in a first direction.

As the agitator oscillates, the ramped camming element is intermittently rotated about the axis of the agitator. Clothes and fabrics undergoing washing move outwardly from the oscillating skirt into the orbit of the intermittently rotating ramp. The inclined ramp causes the clothes and fabrics to be lifted upwardly into the desired toroidal rollover pattern. The mode of operation is repeated continuously throughout the washing period so that all portions of the wash load are exposed to effective scrubbing action.

THE DRAWINGS

FIG. 1 is a perspective view, partly broken away, of an automatic washing machine provided with an improved agitator means according to the present invention.

FIG. 2 is a vertical cross-sectional view of the tub and the improved agitator means of the present invention during the washing cycle, showing the manner in which the clothes are rolled over to insure efficient contact with the wash liquid and scrubbing vanes.

THE PREFERRED EMBODIMENTS

Figure 3:
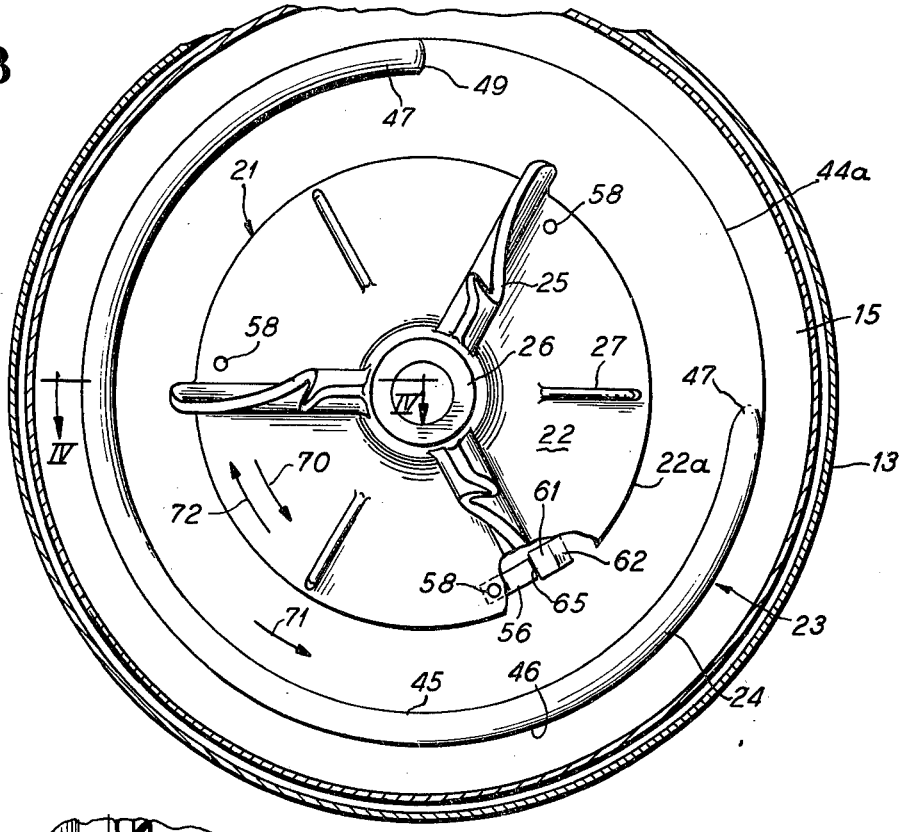
FIG. 3 is a top plan view, partly cut away of the interior of the wash tub and clothes receptacle.

A washing machine 10 of the automatic, vertical axis type is shown generally in FIG. 1, comprising a cabinet 11 having a hinged lid 12 for permitting access to the interior of the machine 10. Within the cabinet 11 is an imperforate, fluid retaining tub 13. The tub 13 is retained within the cabinet 11 by means of usual supports 14 such as suspension rods. A perforate washing receptacle or basket 15 is mounted coaxially within the tub 13.

Within the washing receptacle or basket 15 and tub 13 is an improved agitator assembly 20 constructed in accordance with the principles of the present invention. The agitator assembly 20 comprises a first, vaned, upper agitator element 21 having a lower, generally radially extending skirt portion 22. A second, lower agitator camming element 23 is mounted below the skirt 22 and carries a clothes contacting or camming ramp 24 about a portion of its periphery. The upper agitator element 21 carries a plurality of large vanes 25 extending radially outwardly from an upper barrel portion 26 of the agitator 21 and vertically of the skirt portion 22. Also carried on the skirt portion 22 are smaller scrubbing vanes 27. The upper agitator element 21 is driven by electro-mechanical means indicated at 28 including an electric motor and mechanical transmission and a drive shaft 29 extending upwardly through the barrel 26 of the upper agitator element 21, as better shown in FIG. 2.

Other structural portions of the washing machine 10 include wash liquid inlet means 30 and drain means 31, each comprising appropriate hoses and valves as is conventional in the art. A control console 32 includes suitable controls for the washing machine 10. These controls permit an operator to pre-select washing cycle modes and time periods.

As shown in FIG. 2, the drive shaft 29 extends upwardly through the barrel of the upper agitator element 21 and engages an upper portion 35 thereof through a splined connection 36. Oscillation of the drive shaft in a conventional manner causes the upper agitator element 21 with the vanes 25 and 27 thereon and the skirt 22 thereof to oscillate rotationally within the clothes washing receptacle 15.

As also shown in FIG. 2, the desired motion for articles of clothing and fabrics 45 within the clothes basket 14 in the presence of a washing fluid 46 is a toroidal pattern, wherein the clothes and fabrics 45 are moved downwardly along the agitator barrel 26, outwardly along the agitator skirt 22, upwardly along the outer wall of the basket 15, and inwardly at the surface of the wash fluid 46. Such rollover action exposes the articles 45 uniformly to the scrubbing action of the vanes 25 and 27, assuring good washing results.

In the prior art, a conventional agitator employed within a wash basket is unable to obtain adequate rollover when the clothes load is heavy due to the crowded conditions in the washing receptacle. Use of a two-part agitator, comprising an oscillating lower portion with scrubbing vanes and a unidirectionally rotating upper portion with a helical auger vane thereon has been shown to provide outstanding rollover characteristics even with very heavy wash loads, as shown in U.S. Pat. Nos. 3,987,508, 3,987,651, and 3,987,652, all assigned to the assignee of the present application.

In accordance with the present invention, a different form of two-part agitator is provided herein to effect positive rollover of heavy loads of clothes in a washing machine. A second, separate lower agitator or camming element 23 is mounted below the skirt portion 22 of the upper agitator element 21 and upwardly of a lower and central wall portion 40 of the clothes washing receptacle 15. The lower camming element 23 is maintained in concentric relation to the clothes basket 15 and the upper agitator portion 21 by an upstanding central collar portion 41 which abuts against a corresponding neck portion 42 of the lower basket wall 40. A bearing bead 43 extending about a lower side of the element 23 bears against the wall 40 of the basket 15 to provide a low friction bearing and support means. A radially-extending portion 44 of the camming element 23 is spaced from the lower basket wall 40.

Figure 4:
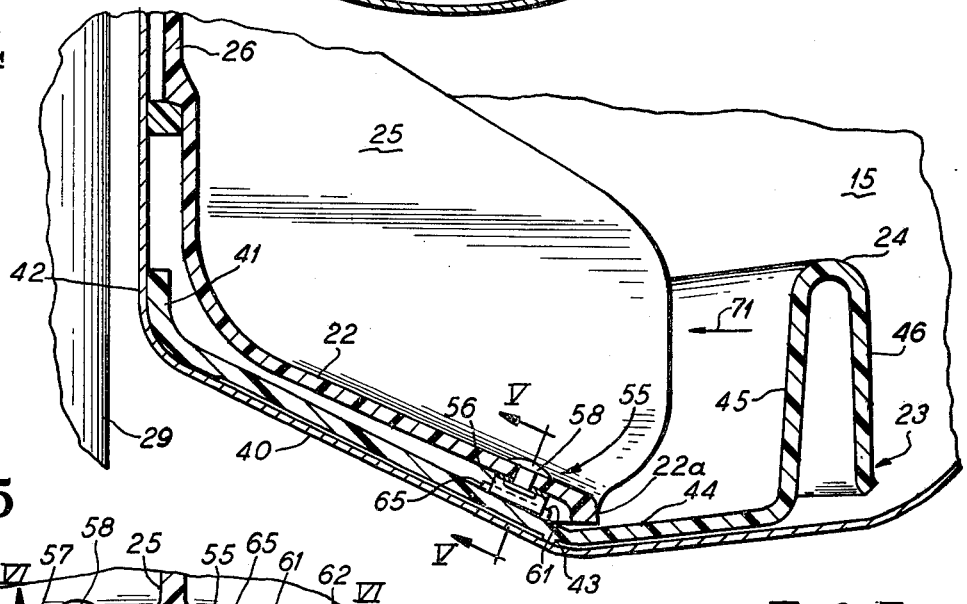
FIG. 4 is a sectional view of a lower portion of the agitator and the camming element, on line IV—IV of FIG. 3.

The ramp means 24 is formed about the periphery of the radially extending portion 44 of the lower agitator element 23. In the embodiment of FIGS. 3 and 4, the ramp 24 is formed as a raised, overturned rim with sloping inner and outer walls 45, 46. The ramp 24 extends circumferentially from a level substantially even with a peripheral outer lip **22*a* of the skirt 22 at 47 in FIG. 2 to a height well above the level of the skirt and to a circumferentially opposite end 49 (see FIG. 3) of the lower element 23. The ramp 24 drops off abruptly in the circumferential direction at a wall 46. In those radial portions of the lower element 23 not bounded by a portion of the ramp 24, the radially extending portion 44 of the element 23 may define a rim 44*a* to complete a full circle as in FIG. 3 or may include a rim portion which recede inwardly as in FIG. 1 at 50**.

Thus within the washing receptacle 15 are both an oscillating agitator 21 and also a unidirectionally rotatable clothes camming means 23 comprising a radially extending portion 44 carrying a clothes camming surface or ramp 24 arranged outwardly of the skirt 22 and vanes 25 and 27 of the agitator 21. In accordance with the invention, the lower element 23 is coupled to engage with the skirt 22 for unidirectional, stepwise rotation. Clutch or coupling means 55, provided to effect intermitted unidirectional co-rotation of the upper and lower agitator parts, are shown in FIGS. 3 through 9.

Figure 5:
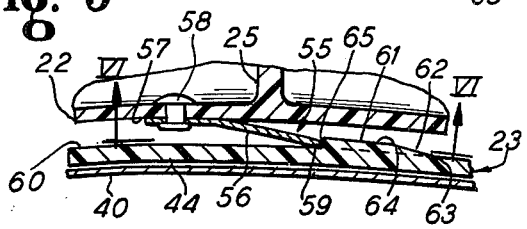
FIG. 5 is a cross section view of a clutch device or coupling member, taken on line V—V of FIG. 4.
Figure 6:
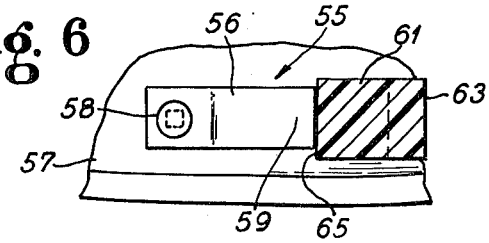
FIG. 6 is a cross-sectional view on line Vi—VI of FIG. 5.
Figure 8:
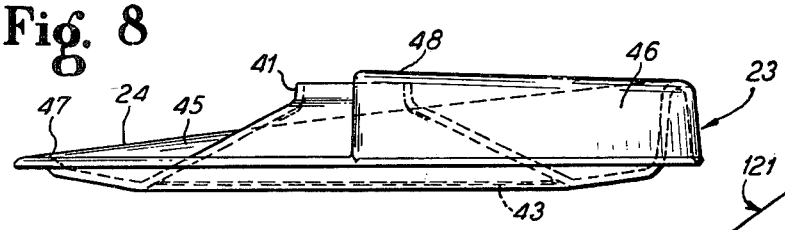
FIG. 8 is a side elevational view of the camming element of the present invention.

A first form of clutch means 55 shown in FIGS. 4 through 6 comprises a metallic spring tab 56 affixed to an undersurface 57 of the agitator skirt 22 as by a square-bodied rivet 58 extending through the agitator skirt 22 as shown. Each spring tab 56 has a free end 59 spaced downwardly from the undersurface 57 of the agitator skirt 22 to bear against an upper surface 60 of the radially extending portion 44 of the lower agitator element 23. The portion 44 is provided at intervals with lugs 61 extending upwardly therefrom. Each lug 61 has a forward face 62 which is sloped to merge with the upper surface 60 of the portion 44 as at 63 in FIG. 5, an upper surface 64 which extends parallel to the lower surface 57 of the agitator skirt 22, and a rear face 65 for abutting engagement with the free end 59 of the spring tab 56. As shown in FIG. 6, the lug 61 is somewhat wider in a radial direction than the spring tab 56, to assure positive engagement between the spring tab 56 and the surface 65 of the lugs 61. Any other suitable means of attachment of the spring tab 56 to the agitator skirt 22 may be employed in place of the square-body rivet 58.

Figure 7:
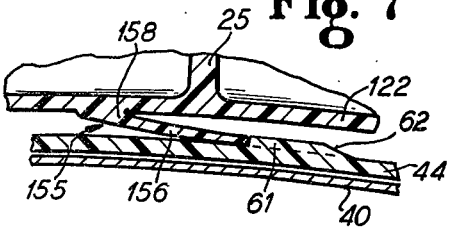
FIG. 7 is a side sectional view through a second embodiment of a clutch or coupling means, similar to FIG. 5.

FIG. 7 shows an alternate clutch or coupling means 155 wherein a spring tab 156 is molded integrally as at 158 with a modified agitator skirt 122. The spring tab 156 is flexible to assure engagement of the tab with the lug 61 on the camming element 23.

The effect of the configuration of the coupling means 55 or 155 is to positively connect the lower agitator element 23 with the upper agitator element 21 during at least a portion of a forward oscillation of the upper agitator 21, in the direction of arrow 70 in FIG. 3. In a configuration wherein three coupling members 55 are employed, spaced at 120° intervals about the agitator skirt 22 as shown in FIG. 3 at the rivets 58, oscillation of the upper agitator element 21 through an arc between 120° and 240° will rotate the lower agitator element 23 through 120° in the direction of arrow 71. Commonly an agitator 21 will oscillate through approximately 196°, depending upon transmission characteristics in the drive means 28, and so the ramp 24 will be advanced by 120° in a counterclockwise direction in the orientation of FIG. 3 upon each oscillation in the direction 70 of the agitator 21. During each return oscillation in the direction 72 as shown in FIG. 3, the spring tabs 56 or 156 will slide over the surfaces of the lugs 61 without engagement therewith. The lower agitator element 23 and the ramp 24 thereof will therefore not be rotated in a reverse direction. Rotation of the lower agitator element 23 and the ramp means 24 thereon in the counterclockwise direction in FIG. 3, in the direction of arrows 71 in FIGS. 2 and 4, will cam the articles of clothing 45 upwardly adjacent the outer wall of the basket 15 as desired to effect a toroidal movement of the articles. By varying the height of the uppermost part 48 (FIG. 3) of the ramp 24 together with the arc of rotation thereof in the direction 71, the degree of the toroidal rollover action induced by the agitator assembly can be controlled.

Figure 9:
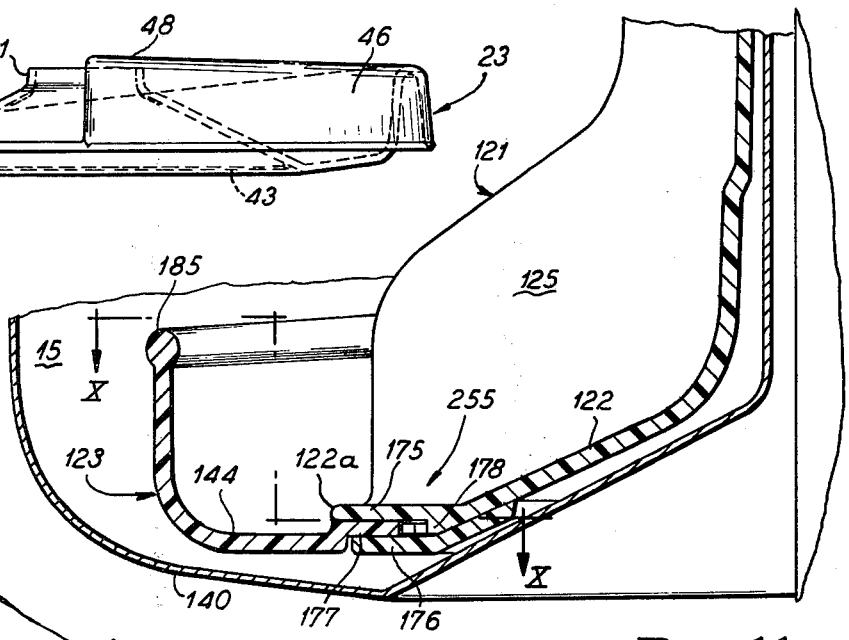
FIG. 9 is a side sectional view through a second form of the agitator and camming element of the present invention.
Figure 10:
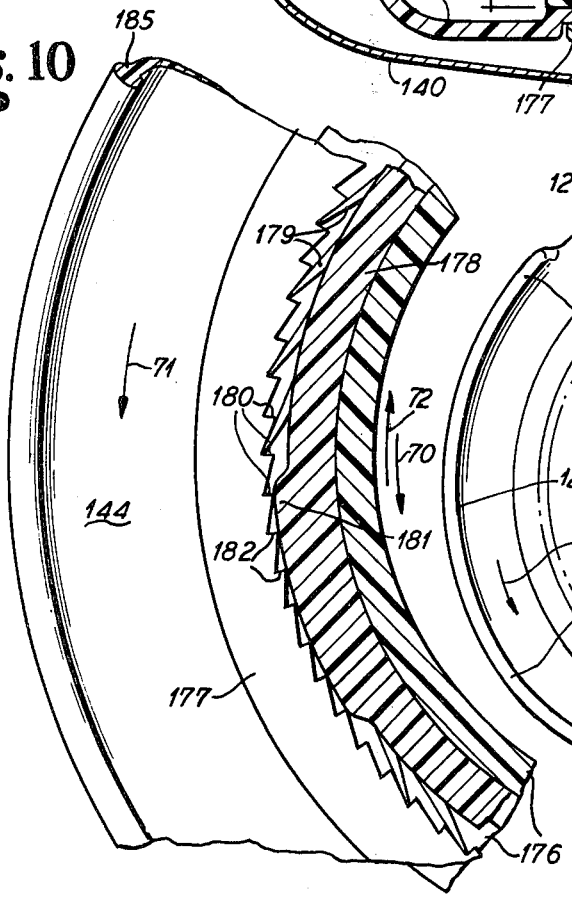
FIG. 10 is a top view, partly in section, taken on line X—X of FIG. 9.
Figure 11:
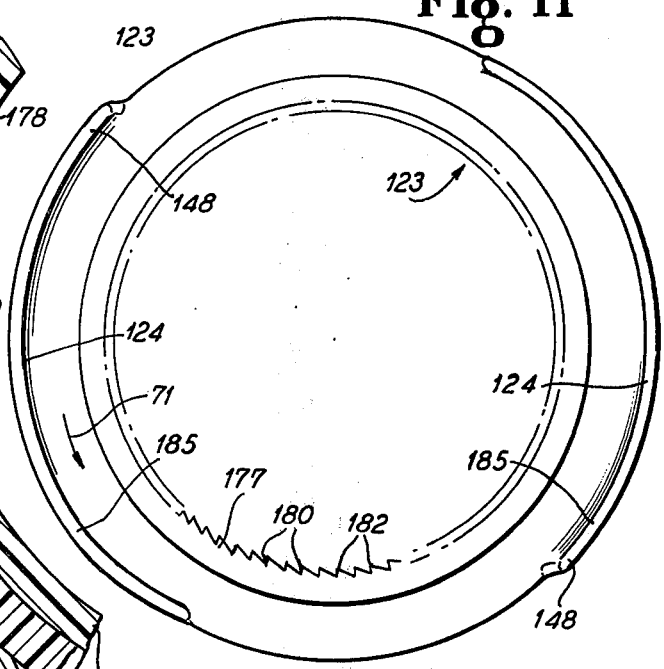
FIG. 11 is a top, plan view of a second form of the camming element of the present invention.
Figure 12:
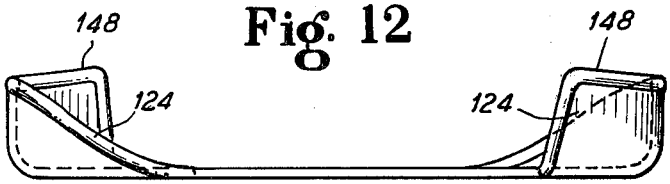
FIG. 12 is a side elevational view of the embodiment of FIG. 11.

Alternate embodiments of the coupling or clutch means are shown in FIGS. 9, 10 and 11, and an alternate, two-ramp lower agitator portion is shown in FIGS. 11 and 12.

In FIG. 9, a modified upper agitator element 121 has vanes 125 and a skirt portion 122 similar to that of the preceding figures. However, the skirt portion 122 has on its outer periphery **122*a* a coupling or clutching mechanism 255 comprising a pair of radially extending lips 175, 176. Received axially between these lips is an inwardly extending ratchet portion 177 formed as an inward extension of the lower wall portion 144 of the lower agitator element 123. As better shown in FIG. 10, arranged between the lips 175 and 176 of the agitator skirt 122 is a tooth portion 178 integral with the upper lip 175 and carrying a plurality of flexible teeth 179 integrally therewith. The portion 177 has a series of ratchet notches 180 for cooperating with teeth 179 and facing in an opposite direction. In the embodiment shown, one tooth 179 is provided for every other ratchet notch 180. Also provided on the agitator skirt 122, set between groups of teeth 179, is a contoured area 181 which engages lightly against peaks 182 between the notches 180 of the lower agitator element. Three such contour areas 181** provided at 120° intervals will accurately align the parts as desired.

Use of the alternate coupling means of FIGS. 9 and 10 causes the camming element 123 to rotate in direction 71 essentially through the entire arc of the agitator 121 in the direction 70. Further, because of the relatively greater friction between the lower element 123 and the upper element 121 due to the bearing configuration 176, 177, the lower element 123 will tend to be carried in the reverse direction 72 unless a heavy load of clothing is present in the washing receptacle 15 to oppose such counter-rotation. However, such counter-rotation in the presence of light and moderate loads is desirable for its reduction of torque on the washing machine motor when the camming action of the lower element is less critical to good washing performance.

Shown in FIGS. 11 and 12 is a configuration of the lower agitator element 223 employing a pair of ramp means 124, 124. These dual ramps 124, 124 are generally similar in configuration to the ramps of the previous embodiments, but because of the lesser ramp length the ramps are steeper and give a greater upward thrust to the articles of clothing 45 within the washing basket 15 for equal height terminations 148. The ramps themselves also have slightly different configurations, being only of the thickness of the element bottom 144 but having an enlarged bead 185 (FIG. 10) along the upper surface thereof. The beads 185 reduce fraying of fabrics during the camming activity. According to the present invention the number of ramps defined by the lower agitator element 23 may be selected to provide the degree of rollover desired and one, two, three, or more ramps may be utilized.

In operation, after the clothes receptacle 15 is filled with articles 45 to be washed and detergent, the tub 13 is filled with wash fluid through the inlet means 30. The drive means 28 is activated automatically and the upper agitator element 21 is set into to and fro oscillations. The coupling means 55, or 155, or 255 engages the lower agitator element or camming means 24 or 124 upon the forward, counterclockwise oscillations and drives the ramps 24 or 124 through at least a portion of the forward oscillation of the upper agitator element 21 or 121. During each reverse oscillation in the direction 72 of FIG. 3, in the clockwise direction, the clutch or coupling means slip past one another in the presence of a heavy wash load in the basket 15, allowing the lower element 23 or 123 to be left substantially stationary. Upon resumption of the forward oscillation, the previous cycle is repeated.

Articles of clothing or other fabrics 45 within the washing receptacle 15 are then directed outwardly in the bottom of the receptacle 15 by the vanes 25 and 27 on the upper agitator element 21 and are cammed upwardly by the ramps 24 or 124 along the wall of the basket 15. The articles then pass inwardly toward the agitator barrel 26 at the top of the receptacle 15 and then downwardly along the agitator barrel 26 to complete the rollover cycle. Uniform washability is assured because of the steady turnover or rollover of the clothing articles.

Although various minor modifications may be suggested by those versed in the art, it should be understood that we wish to embody within the scope of the patent warranted hereon all such modifications as reasonably and properly come within the scope of our contribution of the art.

The embodiments of the invention in which an exclusive property or privilege is claimed are defined as follows:

1. In a washing machine having a washing receptacle for containing fabrics to be washed, agitator means within said receptacle, and drive means having a drive shaft engageable with said agitator means, an improvement in said agitator means comprising:

a first agitator element in said receptacle connected to said drive shaft for rotational oscillating motion therewith, said first agitator element having a skirt formed on a lower portion thereof, a second agitator element in said receptacle disposed generally below the skirt of said first agitator element, said second agitator element having fabric camming means projecting upwardly therefrom in the form of a spiral ramp to force fabrics upward in the receptacle, and coupling means interconnecting said first agitator element with said second agitator element for substantially unidirectional rotation of said second agitator element in said washing receptacle to facilitate rollover of fabrics during a washing operation in said receptacle.

2. In an automatic washer having a washing receptacle for containing washing liquid and items to be washed, agitator means within said receptacle for imparting a rollover motion to said items to be washed; and drive means for driving said agitator means in rotary oscillations about a vertical axis; said agitator means more particularly comprising:

an upper agitator element oscillated by the drive means;

a lower agitator element mounted generally below the upper agitator element and co-axial therewith, said lower agitator element being positively rotationally driven by the drive means in one direction only; and camming means carried on the lower agitator elements for imparting an upward motion to the items to be washed.

3. In an automatic washer, agitator means as defined in claim 2, wherein the camming means associated with the lower agitator element for imparting an upward motion to the items to be washed comprises:

ramp means located on a radially outer portion of said lower agitator element.

4. In an automatic washer, agitator means as defined in claim 3, wherein the ramp means comprises:

an inclined ramp surface rigidly affixed to and extending upwardly from a perimeter of the lower agitator element, whereby the unidirectional rotation of the ramp surface with said lower agitator element forces the items to be washed in an upward direction in said washing receptacle.

5. An agitator assembly for a clothes washing machine comprising:

a first agitator element having a vertical axis;

a second agitator element arranged in said machine below and coaxially with said first agitator element;

drive means for driving said first agitator element in an oscillatory motion and for concurrently driving said second agitator element in a unidirectional rotary motion, and spiral ramp means associated with said second agitator element for camming articles adjacent thereto upwardly into said rollover pattern, whereby said first and second agitator elements cooperate to circulate the contents of the machine in a toroidal rollover pattern.

6. In a clothes washing machine having a washing receptacle, agitation means for effecting a rollover movement of the clothes in the receptacle during a washing operation, said agitation means mounted substantially centrally of said washing receptacle and comprising:

an oscillating first element carrying vanes engageable with the clothes to direct them outwardly toward a perimeter of said receptacle as a portion of a rollover pattern, and a unidirectional, intermittently rotating second element mounted below said first element and having ramp means for positively urging clothes upwardly in the rollover pattern, whereby said first and second elements interact to insure positive rollover movement of even heavy loads of clothes during the washing operation.

7. An agitator assembly mounted about a vertical axis within a fabric receiving receptacle of a clothes washing machine, the assembly comprising:

a first, vaned member oscillatable about said vertical axis for scrubbing fabrics placed within said receptacle;

a second, camming member mounted below said first vaned member and rotatable relative thereto, said second member having a spiral ramp extending upwardly from an outer periphery thereof for contacting fabrics;

drive means engaging said first member for imparting an oscillatory movement thereto; and clutch means between said first and second members for imparting an intermittent rotary movement substantially in one direction to said second member during the oscillation of said first member to force fabrics upwardly and thereby to effect a toroidal rollover movement of said fabrics about said vertical axis.

8. In an automatic washing machine having an agitator with a lower skirt portion and scrubbing vanes thereon, a clothes washing receptacle mounted on a vertical axis, and drive means for driving the agitator in oscillatory rotary movements about said axis, the improvement of means for assuring toroidal movement of heavy loads of wash in the receptacle, said means comprising:

a clothes camming means mounted coaxially with and below the agitator skirt and having on a radially outer perimeter thereof at least one ramp means extending smoothly from a level even with a peripheral rim of said skirt to a level above the skirt in a circumferential distance of less than the circumference of the camming means; and clutch means engageable between the clothes camming means and the agitator for driving the camming means in stepwise unidirectional rotations to raise clothes in the washing receptacle upwardly along said ramp means.

9. In an automatic washing machine as defined in claim 8, wherein each of said ramp means is upwardly inclined in a circumferential direction opposite to that of the rotation of the camming means induced by the clutch means.

10. In an automatic washing machine as defined in claim 9, wherein each of the ramp means terminates abruptly at its highest level and drops to below the level of the agitator skirt.

11. In an automatic washing machine as defined in claim 8, wherein each of the clutch means comprises at least one spring tab and at least two lugs engageable therewith, the tab and the lugs being carried on opposite ones of the agitator skirt and the camming means.

12. In an automatic washing machine as defined in claim 11, wherein the tabs and the lugs are vertically oriented with respect to one another.

13. In an automatic washing machine as defined in claim 11, wherein the tabs and lugs are radially oriented with respect to one another.

14. In an automatic washing machine as defined in claim 13, wherein contoured spacing members are provided at intervals between the agitator skirt and the camming means, to maintain alignment therebetween.

15. In a washing machine as defined in claim 1 wherein said coupling means includes means for unidirectionally driving said second agitator element only in the presence of a large closely packed load of fabrics within said receptacle.

* * * * *